US006574921B2

(12) United States Patent
Zimmermann

(10) Patent No.: US 6,574,921 B2
(45) Date of Patent: Jun. 10, 2003

(54) CLOSURE OPERATOR HAVING A HANDLE THAT ROTATES AS THE CLOSURE ROTATES

(76) Inventor: Eric Zimmermann, 25-73 Steinway St., Astoria, NY (US) 11103

( * ) Notice: Subject to any disclaimer, the term of this patent is extended or adjusted under 35 U.S.C. 154(b) by 0 days.

(21) Appl. No.: 09/896,744

(22) Filed: Jun. 29, 2001

(65) Prior Publication Data

US 2003/0000147 A1 Jan. 2, 2003

(51) Int. Cl.[7] ..... E05F 11/54
(52) U.S. Cl. ..... 49/324; 49/460; 49/333
(58) Field of Search ..... 49/460, 461, 324, 49/333, 335, 336, 338; 16/412, 429, 438

(56) References Cited

U.S. PATENT DOCUMENTS

| | | | | | |
|---|---|---|---|---|---|
| 259,191 | A | * | 6/1882 | Mierrill | 49/74.1 |
| 270,310 | A | * | 1/1883 | Harrison | 49/335 |
| 393,401 | A | * | 11/1888 | Shatsick | 49/335 |
| 1,220,144 | A | | 3/1917 | Jones | |
| 1,539,155 | A | | 5/1925 | Brandt | |
| 1,663,175 | A | | 3/1928 | Putnam | |
| 1,670,921 | A | * | 5/1928 | Zimmer | 49/335 |
| 2,576,536 | A | | 11/1951 | Reynaud | |
| 4,860,493 | A | | 8/1989 | Lense | |
| 4,945,679 | A | | 8/1990 | Aumercier | |
| 5,542,213 | A | * | 8/1996 | Freeman | 49/221 |
| 5,910,077 | A | * | 6/1999 | Aumiller et al. | 49/460 |
| 6,122,863 | A | | 9/2000 | Tippin et al. | |

* cited by examiner

*Primary Examiner*—Gregory J. Strimbu
(74) *Attorney, Agent, or Firm*—Collard & Roe, P.C.

(57) ABSTRACT

An operator for moving a closure, such as a window or a door rotatably mounted to a frame, between open and closed positions. The operator including first and second rotatable shafts, a fixed shaft, and a handle. The first and second rotatable shafts and the handle being rotatably mounted to the closure while the fixed shaft is non-rotatably mounted to the frame. The fixed shaft including a gear, the first shaft including a gear at each end thereof, and the second shaft including a gear at one end thereof and the handle at the other end thereof. One of the gears of the first shaft engaging the gear of the fixed shaft and the other one of the gears of the first shaft engaging the gear of the second shaft. To operate the closure operator, a user rotates the handle which rotates the second shaft causing the first shaft to rotate. The geared engagement of the first shaft to the fixed shaft causes the closure to rotate with respect to the frame.

16 Claims, 4 Drawing Sheets

CLOSURE OPERATOR HAVING A HANDLE THAT ROTATES AS THE CLOSURE ROTATES

BACKGROUND OF THE INVENTION

Handles for doors, windows and other portal coverings are known in the art. For example, the following references show doors or windows that work with handles U.S. Pat. Nos. 6,122,863; 4,945,679; 4,860,493; 2,576,536; 1,663,175; 1,539,155; 1,220,144 all incorporated herein by reference.

The present state of the art suffers from the following problem in that none of the references cited above disclose the use of a handle that rotates with the window or door as it is opening or closing thus allowing the user an easier grasp of the door or window.

SUMMARY OF THE INVENTION

The present invention was designed to overcome the problem of the references cited above by presenting a portal covering such as door or window having a handle that rotates as the door or window rotates. Essentially this portal covering includes a handle, that is rotatably mounted onto the portal covering. The handle is coupled to a shaft that is coupled to the portal covering via C-shaped locks or bearings. On an end of the shaft is a bevel gear that meshes with an adjacent bevel gear. The adjacent gear is coupled to a shaft extending on a different axis from the first shaft. There is also a second, oppositely spaced gear positioned on this second shaft opposite the first gear. This second gear on the second shaft couples with a fixed gear that is fixed to a cover frame such as a door frame or a window frame. As the cover rotates within the frame, the handle rotates with this rotating cover allowing a user to always have contact with the handle at all angles of rotation of the cover.

The gears in this case could be in the form of a miter gear, a bevel gear or a direct drive linking two shafts together.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings wherein similar reference characters denote similar elements throughout the several views.

DETAILED DESCRIPTION OF THE PREFERRED EMBODIMENT

Figure 1:
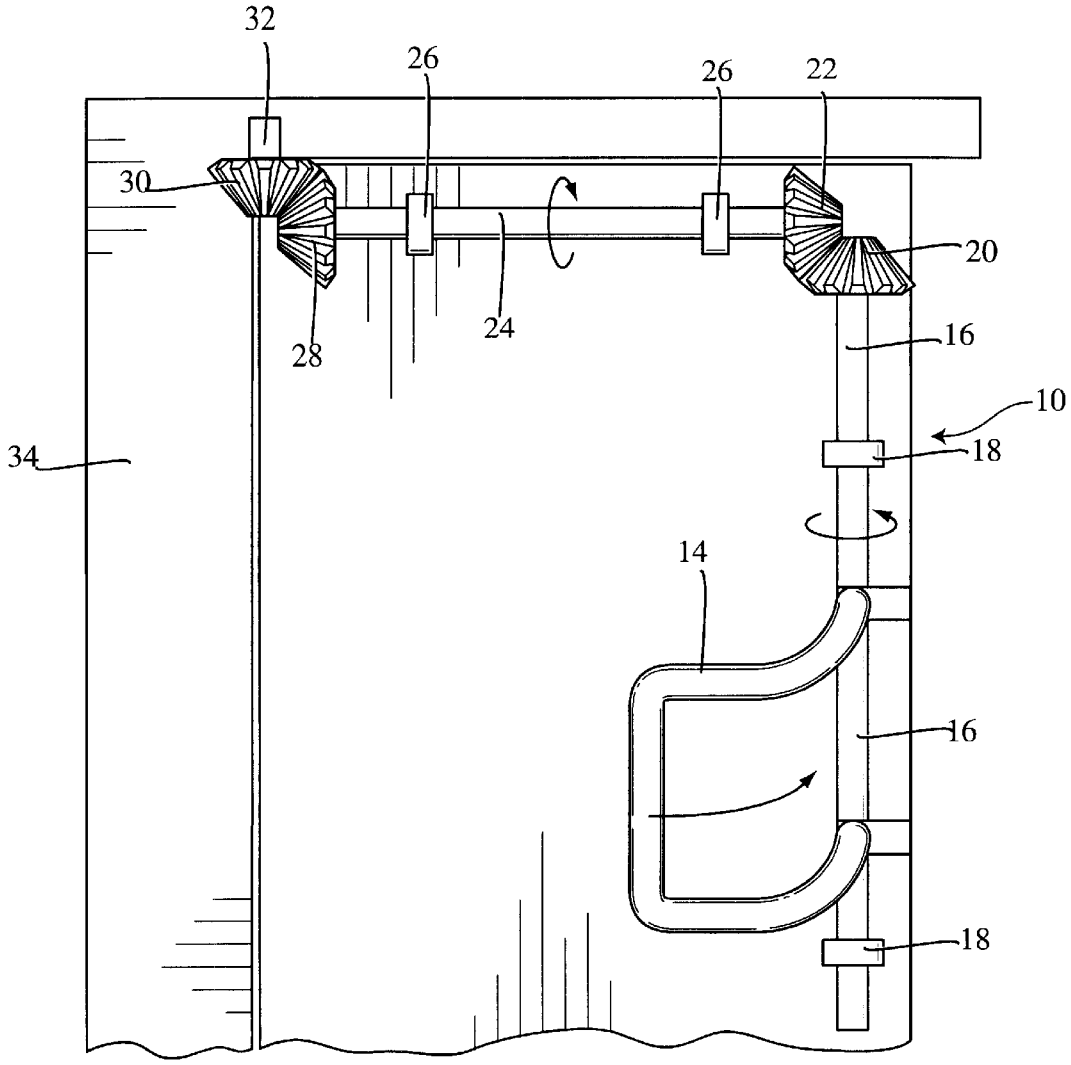
FIG. 1 is a front view of a first embodiment of an open faced cover containing the rotating handle.

FIG. 1 is a front view of a first embodiment of an open-faced portal covering device 10 comprising a portal covering such as a door or window 12 and a rotating handle 14. Rotating handle 14 can be substantially loop shaped or U-shaped so that a user can grab onto handle 14. Handle 14 is coupled to a rotatable shaft 16 that is rotatably coupled to cover 12 via a series of C-shaped locks 18. Disposed at one end of rotatable shaft 16 is a gear 20 such as a bevel gear, that is shaped frusto-conically so that it meshes with an adjacent frusto-conically shaped gear 22.

Frusto-conically shaped gear 22 is coupled to rotatable shaft 24. Rotatable shaft 24 is rotatably coupled to cover 12 via a second series of C-shaped locks 26. These locks 26 allow shaft 24 to rotate inside.

Disposed on an opposite end of gear 22, is gear 28 which rotates as shaft 24 rotates. Gear 28 meshes with fixed gear 30 which is coupled to shaft 32. Shaft 32 is fixed inside of door frame 34.

In operation, as a user grabs handle 14, to open door 12, handle 14 rotates, rotating shaft 16. Shaft 16 rotates within C-shaped locks 18 so that it turns gear 20. As gear 20 rotates, it rotates gear 22 rotating shaft 24 within C-shaped locks 26. Gear 28, which is coupled to rotating shaft 24 rotates with shaft 24 around fixed gear 30. Thus, as a person grabs door handle 14, it automatically starts door or cover 12 turning within its hinges and rotating within frame 34.

Figure 2:
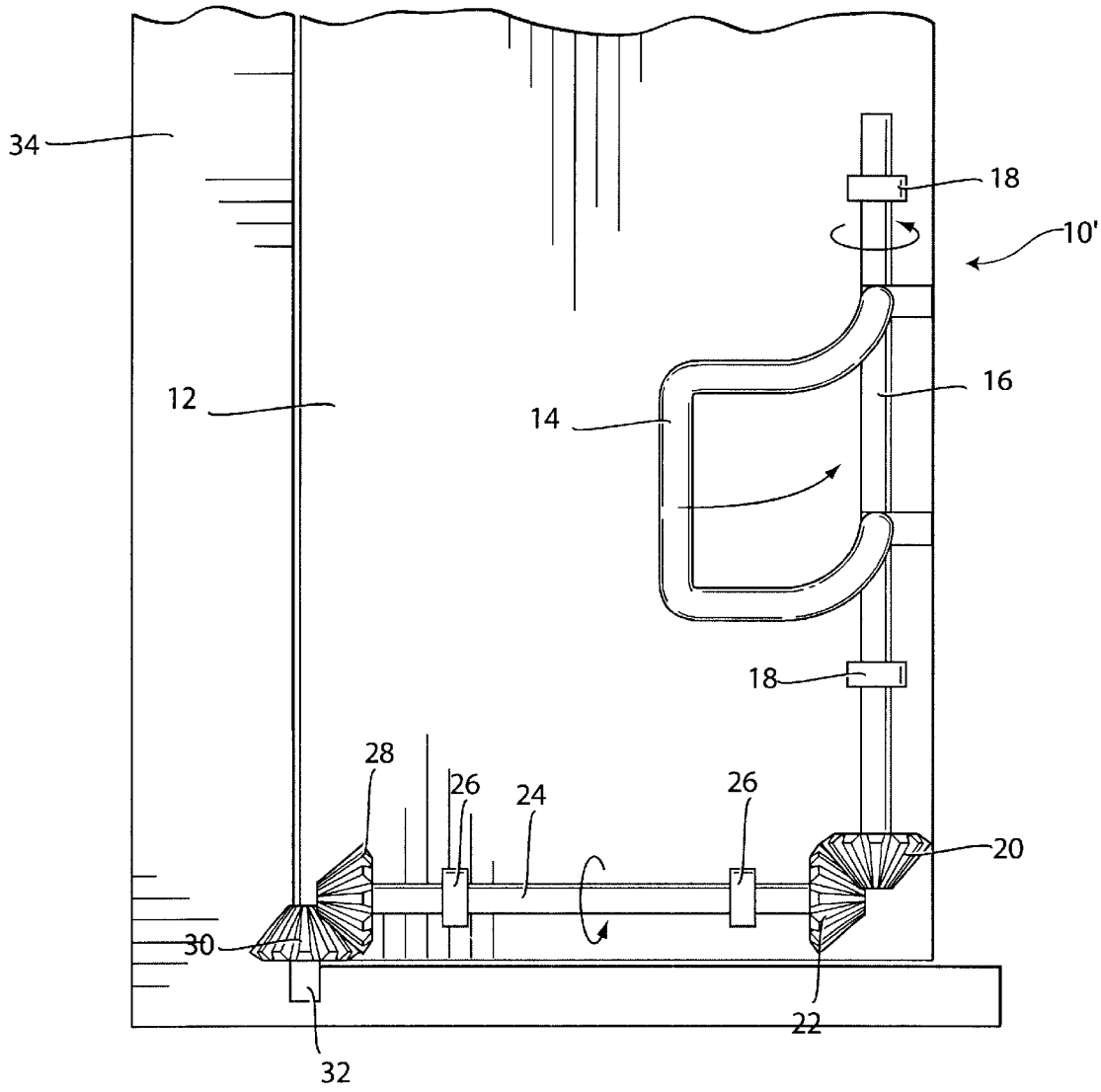
FIG. 2 is a front view of a second embodiment of an open faced cover containing the rotating handle.

FIG. 2 is a front view of a second embodiment of an open door containing the rotating handle. In this embodiment, shaft 26 is placed at the bottom of cover 12 wherein shaft 16 also extends down through C-shaped locks 18 so that gear 20 meshes with gear 22. With this design the above listed components work together in a manner similar to that of the first embodiment.

Figure 3:
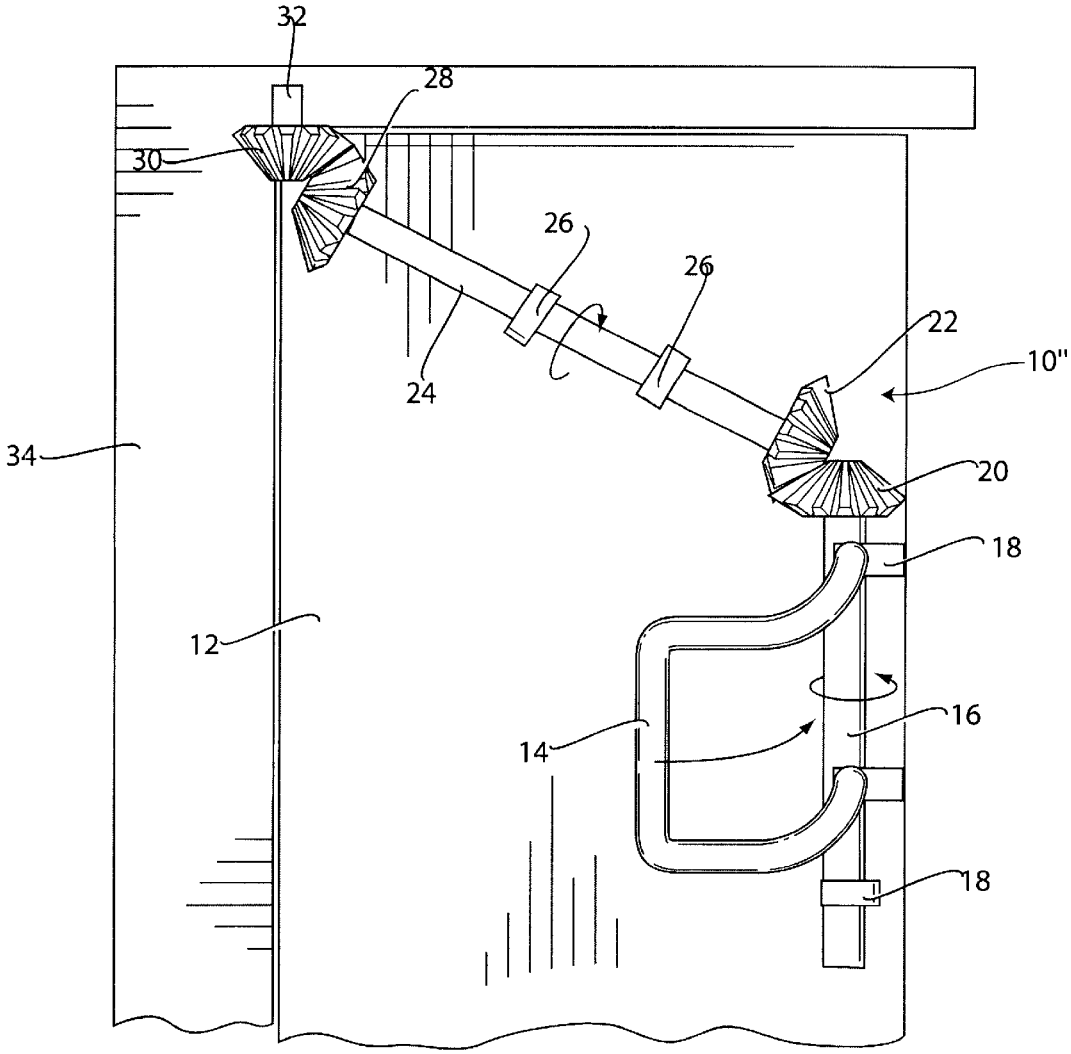
FIG. 3 is a front view of a third embodiment of an open cover containing the rotating handle.

FIG. 3 is a front view of the third embodiment of the invention. With this design, shaft 24 extends diagonally down from stationary gear 30 to gear 20, so that gear 28 meshes with gear 30 and gear 22 meshes with gear 20. C-shaped locks 26 hold shaft 24 in place so that while gear 22 rotates with gear 20 shaft 24 revolves around a single axis.

Figure 4:
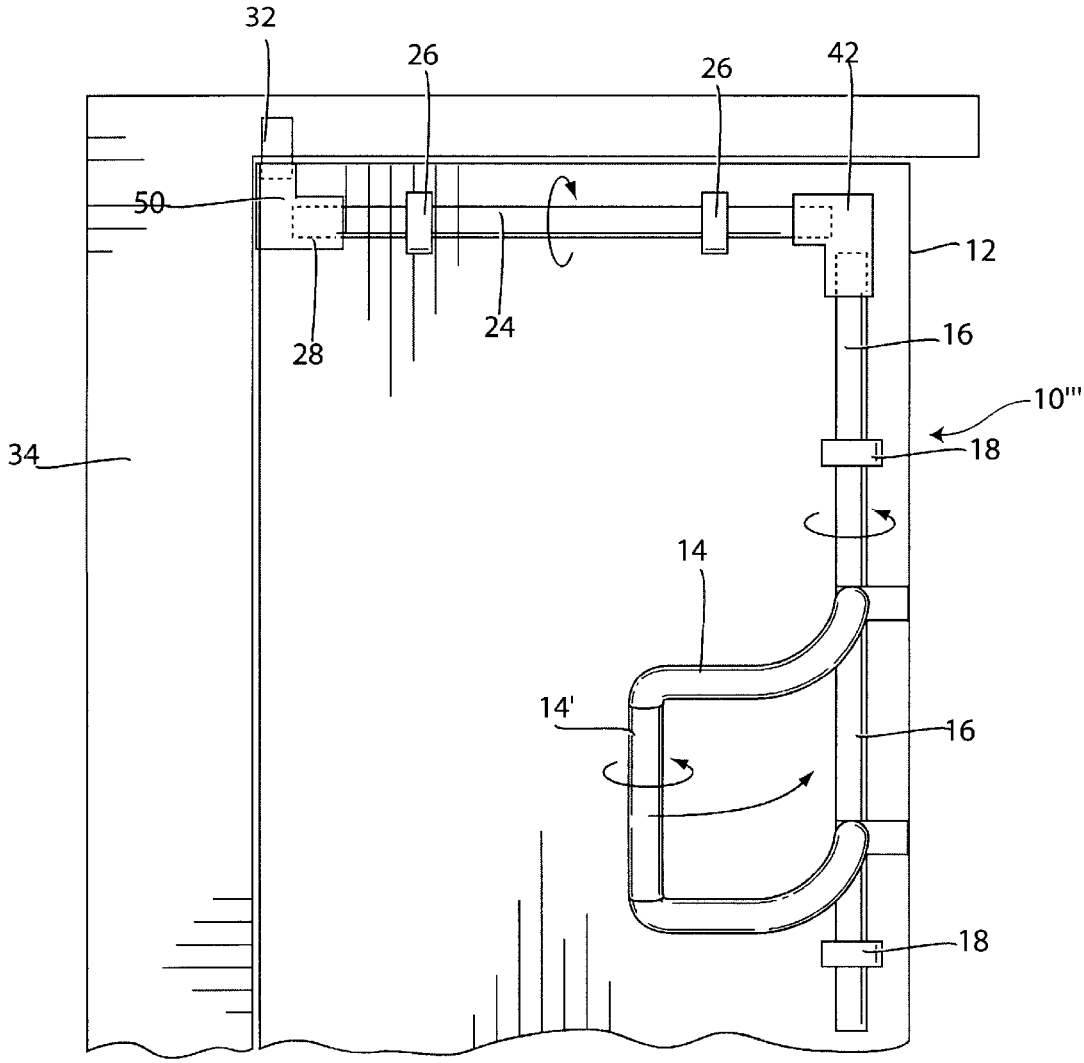
FIG. 4 is a front view of a fourth embodiment of the invention

FIG. 4 is a front view of an open faced cover wherein in this embodiment, there are two direct drives 42, and 50 that are used in place of gears 20 and 22, and 28 and 30 respectively. Direct drives are essentially closed compartments of meshed gears that can be either bevel gears, miter gears, worm gears or any other type of joining apparatus that is used to join to rotatable shafts together at a substantially right angle. In addition, in this embodiment, handle 14 has a rotatable center region 14' which allows this center region to rotate about a vertical axis as the entire handle 14 rotates within cover 12. In that way, the user does not have to loosen his or her grip on handle 14 as it is rotating.

All four embodiments provide the benefit of a door handle that rotates with a door as the door rotates. This handle type arrangement is designed to both rotate in response to the rotation of the door or window but also to help initiate the rotation of the door or window. When a user pulls on handle 14, it starts shaft 16 rotating thus starting gear 20 rotating as well. As gear 20 rotates it rotates gear 22 thus also turning shaft 24 and opposite gear 28. The initiation of rotation of gear 28 against stationary gear 30 starts covering 12 rotating within frame 34. The gears 20, 22, 28 and 30 are selected such that the handle rotates on a 2:1 ratio with respect to the door or window.

Accordingly, while several embodiments of the present invention have been shown and described, it is to be understood that many changes and modifications may be made thereunto without departing from the spirit and scope of the invention as defined in the appended claims.

What is claimed is:

1. A device for covering an opening, the device comprising:

a covering coupled to a frame;

at least one hinge for coupling said covering to said frame;

at least one rotatable handle, rotatably coupled to said covering;

at least one rotatable shaft having a first end coupled to said rotatable handle and an oppositely spaced second end;

at least one stationary shaft non-rotatably coupled to the frame; and a plurality of bevel gears with at least one bevel gear coupled to said oppositely spaced second end of said at least one rotatable shaft and at least one additional bevel gear coupled to said at least one stationary shaft with said at least one bevel gear and said at least one additional bevel gear meshing together such that when said handle rotates one of toward and away from the covering, said at least one rotatable shaft rotates around said at least one stationary shaft causing said covering to rotate.

2. The device as in claim 1, further comprising at least one additional rotatable shaft, wherein said at least one additional rotatable shaft extends coaxially with said at least one rotatable handle and said at least one additional rotatable shaft is coupled to said at least one rotatable shaft so that when said at least one additional rotatable shaft rotates, it rotates said at least one rotatable shaft.

3. The device as in claim 2, wherein said at least one bevel gear and said at least one additional bevel gear are dimensioned so that said at least one rotatable handle rotates on a 2:1 ratio with respect to said covering as said covering rotates.

4. The device as in claim 2, wherein said at least one rotatable shaft extends perpendicular to said at least one additional rotatable shaft.

5. The device as in claim 4, wherein said covering is a door and said at least one rotatable shaft is positioned at a top region of said door.

6. The device as in claim 4, wherein said covering is a door and said at least one rotatable shaft is positioned at a bottom region of said door.

7. The device as in claim 1, wherein said at least one rotatable shaft has one of said plurality of bevel gears couples to said first end thereof.

8. The device as in claim 7, further comprising a plurality of C-shaped locks for rotatably coupling said at least one rotatable shaft and said at least one additional rotatable shaft to said covering.

9. The device as in claim 7, wherein said at least one rotatable shaft extends diagonally from said at least one stationary shaft.

10. The device as in claim 1, wherein said covering is a window.

11. The device as in claim 1, wherein said covering is a door.

12. A device for covering and opening in a building comprising:

a covering coupled to a frame;

at least one hinge for coupling said covering to said frame;

at least one rotatable handle, rotatably coupled to said covering;

at least one rotatable shaft coupled to said rotatable handle; and at least one stationary shaft non-rotatably coupled to said frame;

a plurality of bevel gears coupling said at least one stationary shaft and said at least one rotatable shaft together, such that when said handle rotates one of toward and away from the covering, said at least one rotatable shaft rotates around said at least one stationary shaft using said plurality of bevel gears and causing the covering to rotate.

13. A door disposed in a door frame, the door having a drive device comprising:

at least one rotatable handle rotatably coupled to said door;

at least one rotatable shaft fixedly coupled to said handle and rotatably coupled to said door;

at least one additional rotatable shaft rotatably coupled to said door;

at least one stationary shaft non-rotatably coupled to the frame; and a series of bevel gears with each of said shafts including at least one bevel gear so that when said handle rotates one of toward and away from the door, said additional rotatable shaft rotates about said at least one stationary shaft, through the engagement of said stationary shaft bevel gear and said additional rotatable shaft bevel gear causing the door to rotate.

14. The door as in claim 13, wherein when a user rotates said handle, the door rotates in response to said handle rotating.

15. A door operator comprising:

at least one hinge for coupling a door to a frame;

at least one rotatable handle, rotatably coupled to the door;

at least one rotatable shaft having a first end coupled to said rotatable handle and an oppositely spaced second end;

at least one stationary shaft non-rotatably coupled to the frame; and a plurality of bevel gears with at least one bevel gear coupled to said oppositely spaced second end of said at least one rotatable shaft and at least one additional bevel gear coupled to said at least one stationary shaft with said at least one bevel gear and said at least one additional bevel gear meshing together such that when the handle is rotated one of toward and away from the door, said at least one rotatable shaft rotates around said at least one stationary shaft causing the door to rotate.

16. A door operator comprising:

at least one hinge for coupling a door to a frame;

at least one rotatable handle, rotatably coupled to the door;

at least one rotatable shaft which is rotatable about its longitudinal axis and having a first end coupled to said rotatable handle and an oppositely spaced second end;

at least one stationary shaft non-rotatably coupled to the frame; and a plurality of gears with at least one gear mounted only on said oppositely spaced second end of said at least one substantially rotatable shaft and at least one additional gear non-movably mounted only on an end of said at least one stationary shaft with said at least one gear and said at least one additional gear meshing together wherein when the handle is rotated one of toward and away from the door, said at least one gear rotates around said at least one additional gear causing the door to rotate.

* * * * *